US009939185B2

(12) United States Patent
Sunderland et al.

(10) Patent No.: US 9,939,185 B2
(45) Date of Patent: Apr. 10, 2018

(54) INDOOR AND OUTDOOR AMBIENT CONDITION DRIVEN SYSTEM

(71) Applicant: Parker-Hannifin Corporation, Cleveland, OH (US)

(72) Inventors: Ted W. Sunderland, Washington, MO (US); Dustin B. Searcy, Washington, MO (US); Christian D. Parker, Washington, MO (US); Dave P. Wrocklage, Washington, MO (US); Kevin E. Dorton, Villa Ridge, MO (US)

(73) Assignee: Parker-Hannifin Corporation, Cleveland, OH (US)

( * ) Notice: Subject to any disclaimer, the term of this patent is extended or adjusted under 35 U.S.C. 154(b) by 696 days.

(21) Appl. No.: 14/269,542

(22) Filed: May 5, 2014

(65) Prior Publication Data

US 2014/0326002 A1 Nov. 6, 2014

Related U.S. Application Data

(60) Provisional application No. 61/818,929, filed on May 3, 2013.

(51) Int. Cl.
*F25B 49/02* (2006.01)
*F25B 5/02* (2006.01)

(52) U.S. Cl.
CPC ..... *F25B 49/027* (2013.01); *F25B 5/02* (2013.01); *F25B 2400/075* (2013.01)

(58) Field of Classification Search
CPC ..... F25B 49/027; F25B 5/02; F25B 2400/075
USPC ..... 62/199, 200
See application file for complete search history.

(56) References Cited

U.S. PATENT DOCUMENTS 3,389,576 A * 6/1968 Mauer ..... F25B 49/027 62/183
3,844,131 A * 10/1974 Gianni ..... F25B 1/047 62/149
4,478,050 A * 10/1984 DiCarlo ..... F04B 39/16 62/193
4,566,288 A * 1/1986 O'Neal ..... F25B 41/04 62/117
4,589,263 A * 5/1986 DiCarlo ..... F25B 5/02 62/193

(Continued)

OTHER PUBLICATIONS

Demma, D. "Refrigeration-Retail Food Store Refrigeration and Equipment", 2010 ASHRAE Handbook, pp. 15.14-15.15, 2009.

(Continued)

*Primary Examiner* — Kun Kai Ma
(74) *Attorney, Agent, or Firm* — Renner, Otto, Boisselle & Sklar, LLP

(57) ABSTRACT

A refrigeration system includes a compressor, a condenser, a receiver, an expansion device, and an evaporator in fluid communication with one another. An electronic condenser pressure control valve is in fluid communication with an outlet of the condenser and operative to control a condition at the outlet of the condenser. A controller is operatively coupled to the electronic condenser pressure control valve, the controller including logic configured to operate the electronic condenser pressure control valve to dynamically float the discharge pressure at the condenser outlet based on at least one of one or more system conditions or one or more ambient condition.

25 Claims, 10 Drawing Sheets

(56) References Cited

U.S. PATENT DOCUMENTS 4,862,702 A * 9/1989 O'Neal ..... F25B 41/04 62/196.4
4,949,551 A * 8/1990 Gregory ..... F25B 41/04 62/155
5,070,705 A * 12/1991 Goodson ..... F25B 41/04 62/196.4
5,752,390 A * 5/1998 Hyde ..... F25B 41/00 62/196.4
5,867,995 A 2/1999 Lewis
5,878,589 A * 3/1999 Tanaka ..... B60H 1/00007 165/80.2
6,216,481 B1 4/2001 Kantchev
6,272,870 B1 * 8/2001 Schaeffer ..... F25B 41/04 62/196.4
7,658,079 B2 2/2010 Bailey et al.
7,669,432 B2 * 3/2010 Maier ..... F25B 41/043 236/92 B
7,992,398 B2 8/2011 Tiranno et al.
8,302,415 B2 11/2012 Thybo et al.
9,625,183 B2 * 4/2017 Wallace ..... F25B 9/008
2007/0130971 A1 * 6/2007 Thybo ..... F25B 5/02 62/180
2008/0083233 A1 4/2008 Song
2010/0064723 A1 * 3/2010 Kawakatsu ..... F25B 49/027 62/507
2012/0055185 A1 * 3/2012 Luo ..... F25B 6/02 62/222
2012/0198868 A1 * 8/2012 Huff ..... F25B 41/043 62/115
2012/0227427 A1 * 9/2012 Liu ..... F25B 1/10 62/115
2012/0318006 A1 * 12/2012 Liu ..... F25B 41/043 62/80
2012/0318008 A1 * 12/2012 Liu ..... F25B 9/008 62/115
2012/0318014 A1 * 12/2012 Huff ..... F25B 1/10 62/228.1
2014/0326010 A1 * 11/2014 Kawakami ..... B60H 1/323 62/222
2017/0261245 A1 * 9/2017 Madsen ..... F25B 41/00
2017/0343245 A1 * 11/2017 Fredslund ..... F25B 9/008

OTHER PUBLICATIONS

Demma, D. "Understanding the Fundamentals of Head Pressure Control", RSES Journal, Sporlan Valve Company, 2004.

* cited by examiner

INDOOR AND OUTDOOR AMBIENT CONDITION DRIVEN SYSTEM

RELATED APPLICATION DATA

This application claims the priority of U.S. Provisional Application No. 61/818,929, filed on May 3, 2013, which is hereby incorporated by reference in its entirety.

TECHNICAL FIELD

The present invention relates to a refrigeration system, and more particularly to a system having controls for improving or optimizing refrigeration system performance.

BACKGROUND

The Vapor-compression refrigeration cycle (also referred to as Direct Expansion or DX) is the most widely used refrigeration method for storage space conditioning for perishable products and heating ventilation and air-conditioning applications. A simple DX refrigeration system 10 is represented in FIG. 1.

DX systems achieve a refrigeration effect by using a compressor 12 to compress a refrigerant such that the discharge pressure is greater than the corresponding Saturated Condensing Temperature (SCT), thereby causing the refrigerant at the outlet of a condenser 14 to enter a subcooled liquid state. The subcooled liquid is supplied to an expansion device 16 at discharge pressure and a temperature corresponding to a subcooled state of the refrigerant such that the refrigerant enters the expansion device 16 in a fully liquid state. The outlet of the expansion device 16 is at compressor suction pressure causing the refrigerant to vaporize and achieve the temperature corresponding to the pressure at the outlet of the expansion device 16 or, as depicted in FIG. 1, saturated suction temperature (SST). As the refrigerant vaporizes, heat energy is absorbed by the refrigerant via an evaporator 18 causing the refrigerant to enter a superheated vapor state before returning to the compressor 12 where the refrigerant is compressed and discharged at an elevated pressure and the cycle continues.

The amount of heat energy to be absorbed by the refrigerant to achieve the required evaporator temperature is referred to as heat load or simply load. This transfer of heat energy at the evaporator 18 is expressed as $Q=\dot{m}\Delta h$ where Q is Btu/hr, $\dot{m}$ is mass flow of the refrigerant and $\Delta h$ is the change in enthalpy of the refrigerant.

FIG. 2 shows a schematic diagram of another conventional vapor compression refrigeration system 10'. The system 10' utilizes multiple compressors 12*a*-12*n* in a parallel configuration so as to provide varying amounts of refrigeration capacity in response to variations in load. Multiple evaporators 18*a*-18*n* are connected to a common compressor suction line and a remote outdoor condenser 14 is connected to the common compressor discharge.

Seasonal changes (e.g., ambient air temperature) can affect the SCT, and the amount of liquid refrigerant in the condenser 14 or one or more evaporators 18*a*-18*n* in the system entering a defrosting period, thereby reducing the amount of refrigerant circulating in the system 10'. To compensate for such seasonal changes, the system 10' can include a refrigerant receiver 20 (also referred to as a receiver or a receiver vessel). The refrigerant receiver 20 allows sufficient refrigerant to be placed in the system 10' to account for low outdoor ambient conditions when a substantial portion of the refrigerant will reside in the condenser 14, and high outdoor ambient conditions when excess refrigerant will reside in the receiver 20.

The system 10' shown in FIG. 2 also can include a plurality of expansion valves 16*a*-16*n*. In order for the system to operate, a minimum pressure differential (ΔP) should exist across the expansion valves 16*a*-16*n*. During periods of low outdoor ambient temperatures the SCT will decrease to a level where the corresponding Saturated Condensing Pressure (SCP) will decrease to a pressure that no longer provides the expansion valves 16*a*-16*n* with sufficient pressure differential to operate. It is common practice to place a valve in the condenser outlet piping (Condenser Pressure Control Valve 22) to hold back liquid refrigerant in the condenser 14 during low outdoor ambient conditions to maintain a pressure adequate for proper operation of the expansion valves 16*a*-16*n* as the condensing pressure is approximately equal to the inlet pressure of the expansion valves 16*a*-16*n*. This decreases the effective surface area of the condenser which in turn raises the pressure at the inlet of the expansion valves 16*a*-16*n*. Such mechanical solution, while effective to maintain system operation, operates on a fixed pressure setting set by the installer.

During periods of exceptionally low ambient temperatures and/or low load conditions, low system refrigerant charge, etc. the mechanical limitations of the Condenser Pressure Control Valve 22 can allow the expansion valve inlet pressure to decrease below operational pressures. In order to prevent this condition from occurring, a close on rise of outlet pressure valve 24 (Receiver Pressure Regulating Valve) is provided to bypass the condenser 14 and pressurize the receiver 20 with compressor discharge vapor, thereby raising the inlet pressure to the expansion valves 16*a*-16*n* to a safe operating pressure (see system 10" in FIG. 3). The valve 24 operates on a fixed value as set by the installer and is typically set to maintain a receiver pressure at a value lower than the Condenser Pressure Control Valve 22 setting.

FIG. 4 depicts a system 10''' that includes a close on rise of outlet pressure valve (Liquid Pressure Regulating Valve) 26 to maintain a constant inlet pressure to the expansion valves 16*a*-16*n*, regardless of receiver pressure, as long as receiver pressure is above the Liquid Pressure Regulating Valve outlet pressure setting. This practice allows more accurate sizing of the expansion valve 16*a*-16*n* and consistent operation as the expansion valve capacity varies with inlet pressure.

SUMMARY

The fixed pressure set point of the mechanical Condenser Pressure Control Valve 22 determines the minimum pressure differential across the compressors 12*a*-12*n* (ΔP). Lowering the compressor discharge pressure decreases the compressor ΔP which in turn reduces the energy consumed by the compressor 12*a*-12*n* and increases compressor operating efficiency (EER), which in turn increases system EER. The fixed pressure set point of the mechanical Condenser Pressure Control Valve 22, however, limits the minimum compressor discharge pressure that can be achieved and accordingly the minimum compressor ΔP.

A system and method in accordance with the present disclosure enables the discharge pressure to dynamically "float" with outdoor ambient temperature and/or system conditions. In this regard, discharge pressure is controlled at the condenser outlet using an Electronic Condenser Pressure Control Valve and a Controller. The solution in accordance with the present disclosure overcomes the fixed set point barrier and allows the discharge pressure and accordingly the compressor ΔP to float to the lowest level possible as determined by the outdoor ambient temperature, compressor operating envelope, minimum expansion valve inlet pressure and desired liquid refrigerant subcooling measured at the condenser outlet (condensate). Additionally, condenser refrigerant condensate subcooling can be controlled by varying the condensing pressure. The system described herein also can provide coordinated and enhanced control of an Electronic Receiver Pressure Regulating Valve, Electronic Liquid Pressure Regulating Valve, Electronic Expansion Valves and Electronic Evaporator Pressure Regulating Valves as described herein. The coordinated control of the system can result in reduction in refrigeration system operating cost and improved performance.

The refrigeration system in accordance with the present disclosure includes a compressor, a condenser, a receiver, an expansion device, and an evaporator in fluid communication with one another. The system also includes an electronic condenser pressure control valve in fluid communication with an outlet of the condenser and operative to control a condition at the outlet of the condenser, and a controller operatively coupled to the electronic condenser pressure control valve. The controller includes logic configured to operate the electronic condenser pressure control valve to regulate the condenser outlet condition to a lowest level desired.

According to another embodiment, the refrigeration system in accordance with the present disclosure includes at least one of the following: (i) an electronic receiver pressure regulating valve and an associated controller that controls the electronic receiver pressure regulating valve to control a minimum pressure in the receiver; (ii) an electronic liquid pressure regulating valve and an associated controller that controls the electronic liquid pressure regulating valve to control the liquid refrigerant pressure at the inlet of the expansion device; and (iii) an electronic evaporator pressure regulating valve and an associated controller that controls the electronic evaporator pressure regulating valve to control refrigerant saturation suction temperature and/or refrigerated space temperature.

According to one aspect of the invention, a refrigeration system includes: a compressor, a condenser, a receiver, an expansion device, and an evaporator in fluid communication with one another; an electronic condenser pressure control valve in fluid communication with an outlet of the condenser and operative to control a discharge pressure at the condenser outlet; and a controller operatively coupled to the electronic condenser pressure control valve, the controller including logic configured to operate the electronic condenser pressure control valve to dynamically float the discharge pressure at the condenser outlet based on at least one of one or more system conditions or one or more ambient conditions.

According to one aspect of the invention, the logic configured to operate the electronic condenser pressure control valve to dynamically float the discharge pressure at the condenser outlet based on at least one system condition includes logic configured to operate the condenser pressure control valve based upon at least one of an outdoor ambient temperature, a compressor operating envelope, or minimum expansion valve inlet pressure and desired liquid refrigerant subcooling measured at the condenser outlet.

According to one aspect of the invention, the logic that dynamically floats the pressure at the condenser outlet includes logic that operates the electronic condenser pressure control valve to regulate a condenser outlet condition to a lowest desired level.

According to one aspect of the invention, the condenser outlet condition comprises a condensate pressure or a condensate temperature.

According to one aspect of the invention, the logic configured to operate the electronic condenser pressure control valve to regulate the condenser outlet condition to a lowest desired level includes logic configured to regulate a refrigerant subcooling at the condenser outlet through control of Saturated Condensing Pressure (SCP).

According to one aspect of the invention, the logic configured to operate the electronic condenser pressure control valve to regulate the condenser outlet condition to a lowest desired level includes logic configured to regulate the condenser outlet pressure to be greater than a pressure at the receiver.

According to one aspect of the invention, the system includes at least one of a condenser pressure sensor operative to measure a pressure at the condenser outlet or a condenser temperature sensor operative to measure a temperature at the condenser outlet, the condenser pressure sensor or condenser temperature sensor communicatively coupled to the controller.

According to one aspect of the invention, the system includes an electronic receiver pressure regulating valve in fluid communication with an outlet of the compressor and an inlet of the receiver and operative to control a pressure at the receiver, wherein the controller includes logic configured to operate the electronic receiver pressure regulating valve to regulate a minimum pressure in the receiver.

According to one aspect of the invention, the logic configured to operate the electronic receiver pressure regulating valve to regulate a minimum pressure in the receiver includes logic configured to control the receiver pressure regulating valve to regulate receiver pressure below condenser outlet pressure.

According to one aspect of the invention, the logic configured to operate the electronic receiver pressure regulating valve to regulate a minimum pressure in the receiver includes logic configured to control the receiver pressure regulating valve to regulate a pressure differential across the receiver pressure regulating valve.

According to one aspect of the invention, the logic configured to operate the electronic receiver pressure regulating valve to regulate a minimum pressure in the receiver includes logic configured to control the receiver pressure regulating valve to regulate an outlet pressure of the receiver pressure regulating valve.

According to one aspect of the invention, the system includes a receiver pressure sensor communicatively coupled to the controller, the receiver pressure sensor operative to measure a pressure at an outlet of the electronic receiver pressure regulating valve.

According to one aspect of the invention, the system includes an electronic liquid pressure regulating valve arranged between and in fluid communication with the receiver and the expansion device, the electronic liquid pressure regulating valve operative to control a pressure at an inlet of the expansion device.

According to one aspect of the invention, the controller includes logic configured to operate the electronic liquid pressure regulating valve to regulate the pressure at the inlet of the expansion device based on at least one of a temperature or pressure of a refrigerant exiting the electronic liquid pressure regulating valve.

According to one aspect of the invention, the system includes at least one of a liquid pressure sensor operative to measure a pressure at an outlet of the liquid pressure regulating valve or a liquid temperature sensor operative to measure a temperature at the liquid pressure regulating valve, the liquid pressure sensor or liquid temperature sensor communicatively coupled to the controller.

According to one aspect of the invention, the expansion device comprises an electronic expansion device, and the controller includes logic configured to operate the electronic expansion device to regulate refrigerant superheat based on at least one of evaporator outlet temperature, evaporator outlet pressure, expansion valve outlet temperature, expansion valve inlet temperature, expansion valve inlet pressure, expansion valve flow profile, expansion valve percentage open or calculated refrigerant superheat.

According to one aspect of the invention, the system includes at least one of an evaporator pressure sensor operative to measure a pressure at an outlet of the evaporator or an evaporator temperature sensor operative to measure a temperature at the outlet of the evaporator, the evaporator pressure sensor or evaporator temperature sensor communicatively coupled to the controller.

According to one aspect of the invention, the system includes an electronic evaporator pressure regulating valve in fluid communication with an outlet of the evaporator.

According to one aspect of the invention, the controller includes logic configured to operate the electronic evaporator pressure regulating valve to regulate refrigerant saturated suction temperature (SST) in the evaporator or refrigerated space temperature based on evaporator outlet pressure or refrigerated medium temperature.

According to one aspect of the invention, the system includes a second expansion device and a second evaporator in fluid communication with the compressor, the condenser, and the receiver, wherein the second expansion device and the second evaporator are in parallel with the expansion device and the evaporator.

According to one aspect of the invention, the system includes at least one additional compressor in parallel with the compressor.

According to one aspect of the invention, the controller is a central controller operatively coupled to each of the valves.

According to one aspect of the invention, the controller comprises a plurality of controllers communicatively coupled to each other, each of the plurality of controllers operatively coupled to a respective one or more of the valves.

According to one aspect of the invention, a method is provided for controlling a refrigeration system that includes a compressor, a condenser, a receiver, an expansion device, and an evaporator in fluid communication with one another. The method includes dynamically floating a discharge pressure of the condenser based on at least one of one or more system conditions or one or more ambient conditions.

According to one aspect of the invention, dynamically floating comprises regulating an outlet condition of the condenser to a lowest desired level.

According to one aspect of the invention, regulating an outlet condition comprises regulating a condensate pressure or a condensate temperature at the outlet of the condenser.

BRIEF DESCRIPTION OF THE DRAWINGS

Embodiments of this invention will now be described in further detail with reference to the accompanying drawings.

DETAILED DESCRIPTION

As used herein, floating the condenser discharge pressure is defined as dynamically changing the condenser outlet pressure based on one or more variables.

Figure 1:
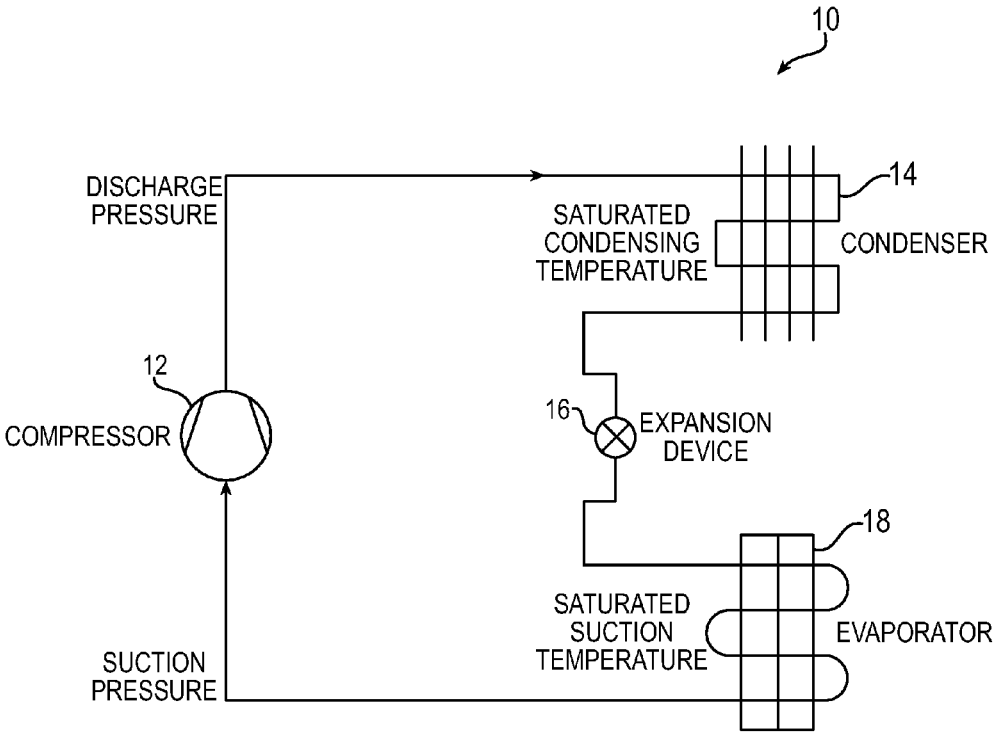
FIGS. 1-4 are schematic diagrams of conventional vapor compression refrigeration systems.
Figure 2:
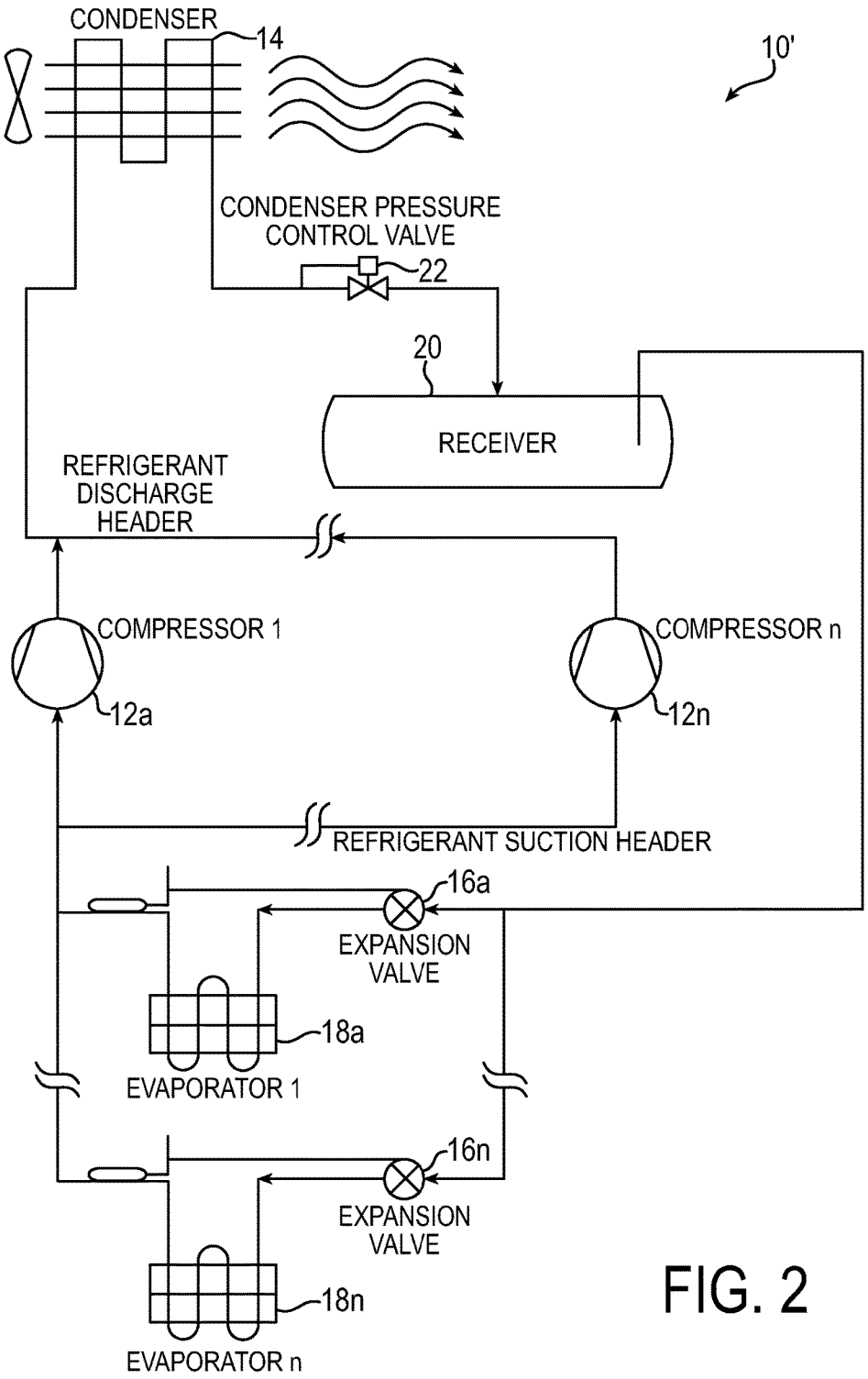
Figure 3:
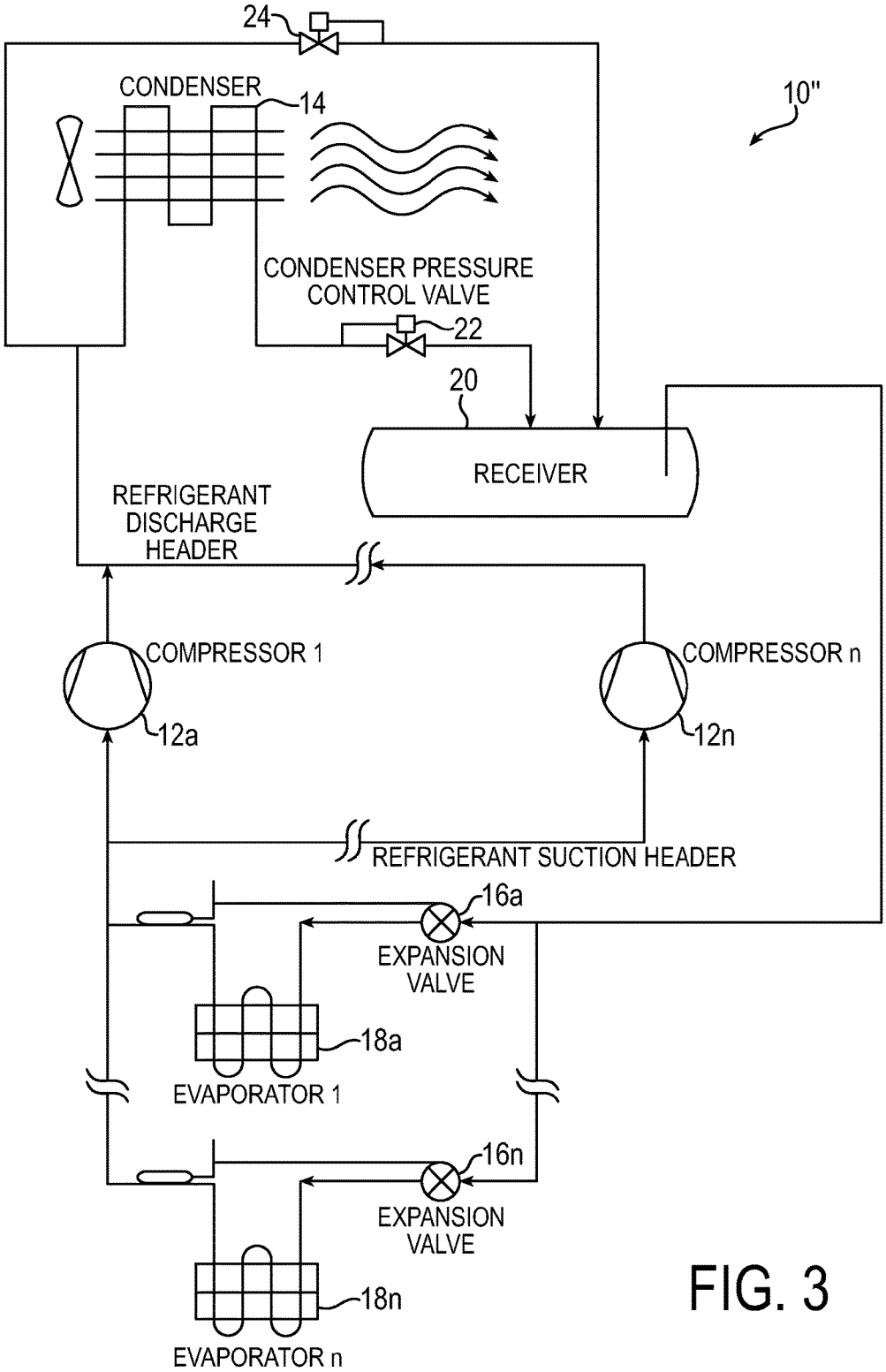
Figure 4:
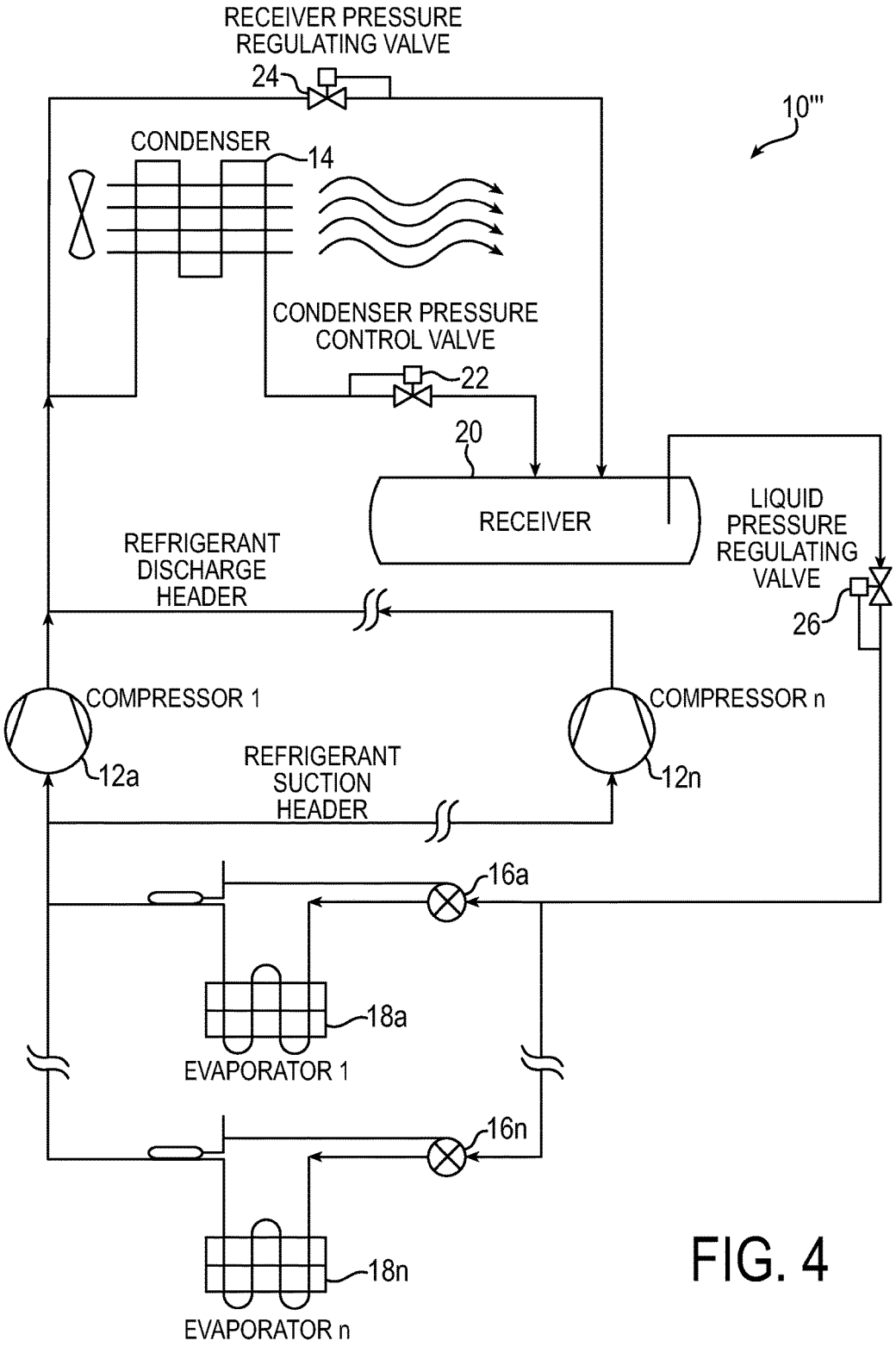
Figure 5:
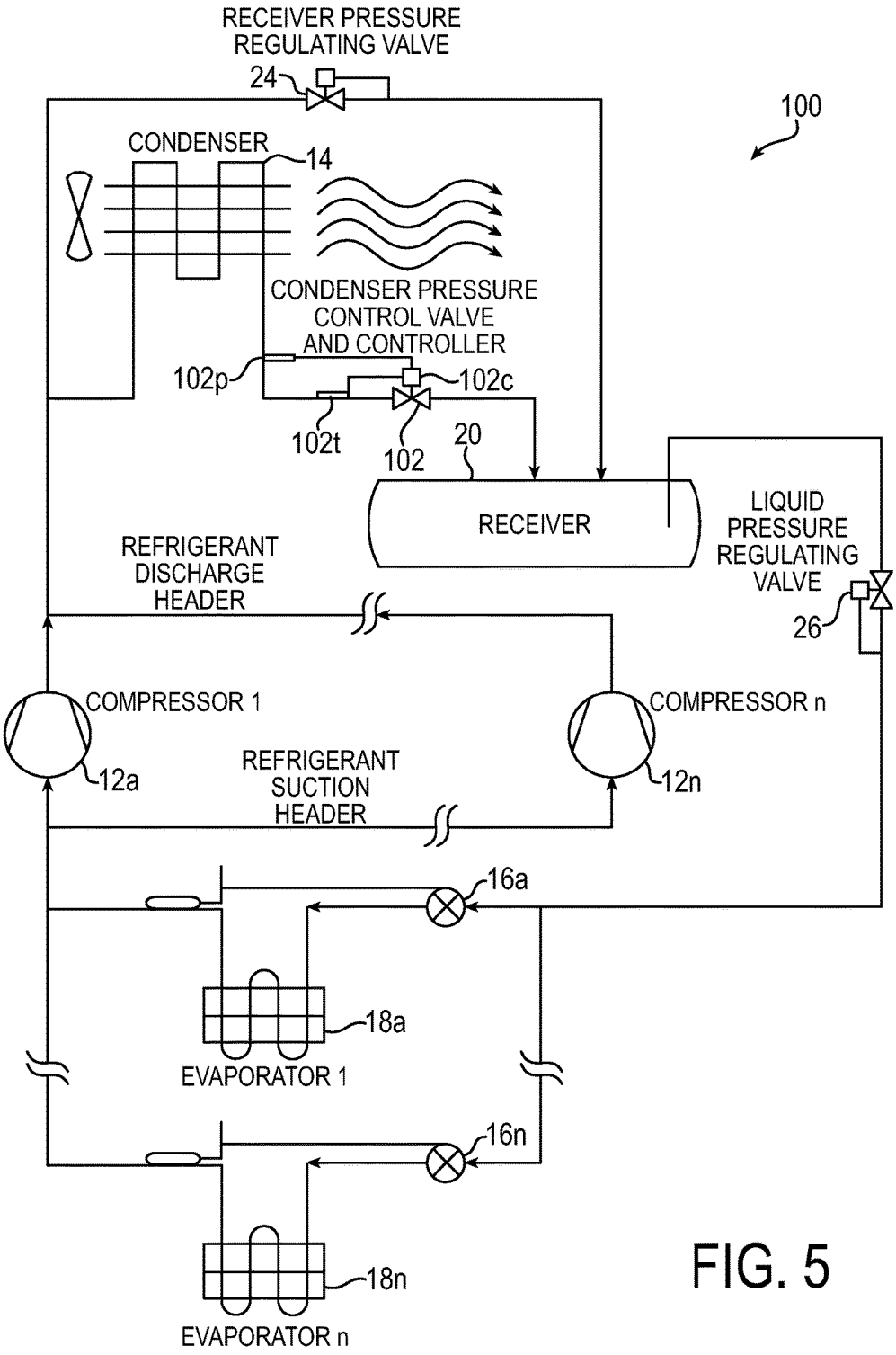
FIG. 5 is a schematic diagram of an exemplary vapor compression refrigeration system in accordance with aspects of the invention.

An exemplary schematic diagram of a vapor compression system 100 in accordance with aspects of the invention is shown in FIG. 5. Instead of the mechanical condenser pressure control valve 22 as depicted in the prior art, the system 100 includes an electronic condenser pressure control valve 102, which is in fluid communication with an outlet of the condenser 14, and an associated controller 102*c* for providing microprocessor-based intelligent control. The electronic valve 102 can be operated to control the condenser outlet conditions (e.g., condensate pressure and or temperature or both) in proportion to a signal from the controller 102*c*.

The valve 102 can include a piston positioned, for example, by a stepper motor driven linear actuator (not shown) and the controller 102*a*. A condenser pressure sensor 102*p* and condenser temperature sensor 102*t* provide pressure and temperature measurements, respectively, as measured at an outlet of the condenser 14 to the controller 102*c*. The controller 102*c* includes logic configured to operate the valve 102 to regulate the pressure at the condenser outlet. In this regard, the controller 102*c* operates the valve to maintain the lowest desired condenser outlet pressure that remains greater than the receiver pressure (which is controlled by the receiver pressure regulating valve 24). The lowest desired condenser outlet pressure is the lowest pressure possible that will achieve optimal efficiency and performance for a given location or system.

The lowest condensing pressure may be calculated by the controller using the SCP at the current ambient temperature plus the condenser temperature drop (TD) (approximately 10° F.). Further, an additional 3-10 degrees of subcooling may be needed to ensure fully liquid state refrigerant. Therefore, an additional 2 to 10 psi may be added to the pressure setpoint for the valve 102.

An advantage of using the electronic condenser pressure control valve 102 instead of a mechanical condenser pressure control valve is the ability to dynamically control the condenser discharge pressure at the outlet of the condenser 14. System efficiency is increased when the condenser outlet pressure is regulated to be at a minimum value (as dictated by ambient and/or system conditions). The electronic condenser pressure control valve 102 enables the static set point barrier of mechanical valves to be overcome and allows the condenser discharge pressure (and accordingly the compressor ΔP) to float to the lowest level desired (e.g., the lowest condensing pressure at which a solid column of liquid refrigerant is exiting the condenser) based upon numerous variables, including, but not limited to, the outdoor ambient temperature, compressor operating envelope (i.e., the range of differential pressures and temperatures where the compressor will operate), minimum expansion valve inlet pressure and desired liquid refrigerant subcooling measured at the condenser outlet (condensate). The variables are dynamic and are supplied to the controller 102*c* of the electronic valve 102 as variable operating parameters specific to the application. The operating parameter values are sensed and/or calculated from sensed values and/or input by the user, and can be input in real time.

The controller 102*c*, which may be incorporated into the electronic valve 102 as shown in FIG. 5 and/or which may be a standalone controller as depicted in other embodiments, can utilize condenser outlet (condensate) temperature, condenser outlet pressure and the calculated refrigerant subcooling as the process variable inputs (the sensed values) to provide floating discharge pressure control. Additionally, the valve may be positioned by the controller 102*c* to maintain desired or calculated refrigerant subcooling at the condenser outlet through control of the SCP by the electronically controlled valve 102 as determined by the controller 102*c*.

Figure 6:
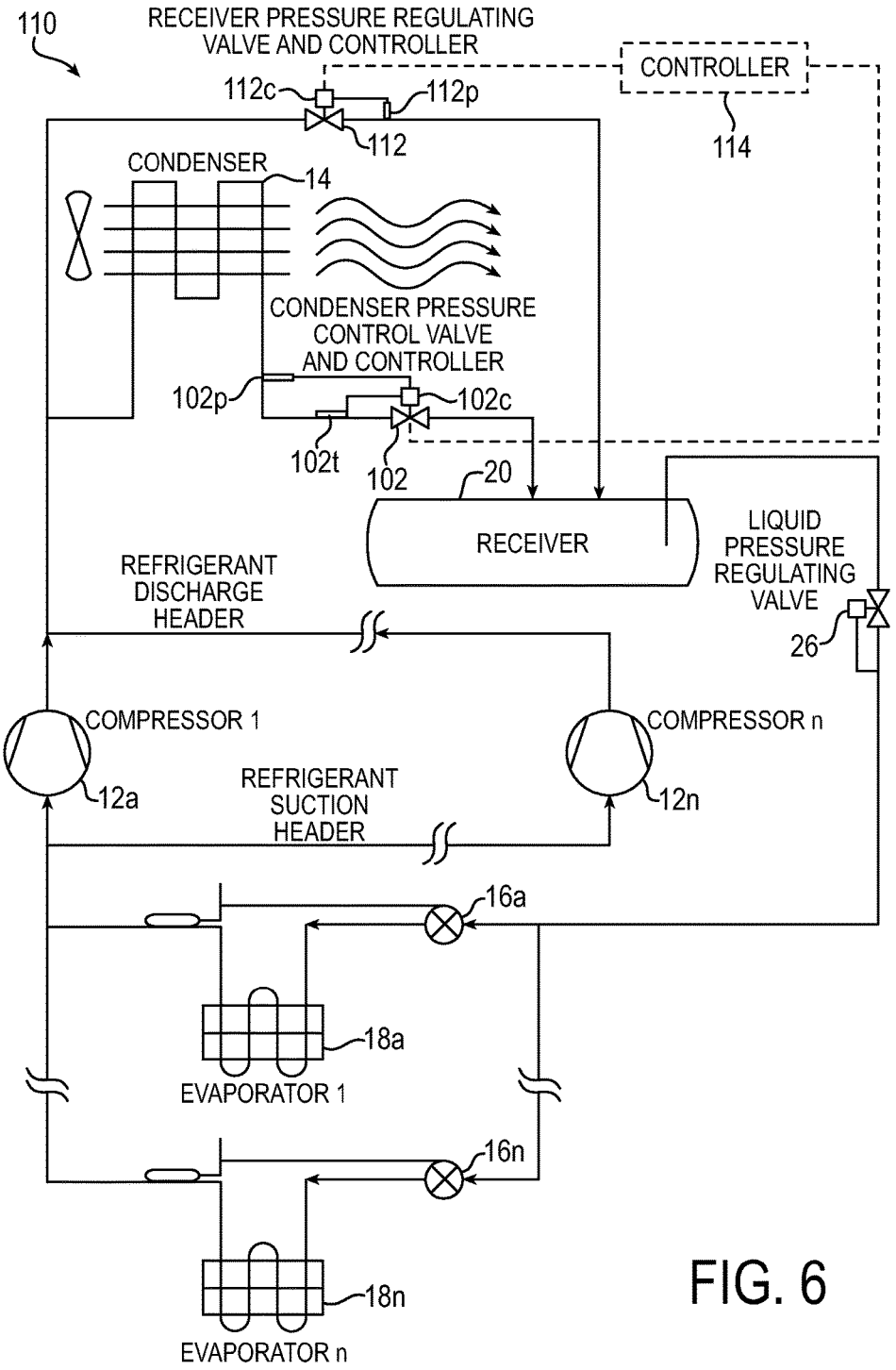
FIG. 6 is a schematic diagram of another exemplary vapor compression refrigeration system in accordance with aspects of the invention.

FIG. 6 is an extension of the embodiment of FIG. 5. Instead of a mechanical receiver pressure regulating valve 24 as depicted in the prior art, the system 110 of FIG. 6 includes an electronically controlled Receiver Pressure Regulating Valve 112 (which is arranged between and in fluid communication with the compressor 12 and receiver 20) and associated controller 112*c* for providing microprocessor-based intelligent control. The controller 112*c* includes logic configured to operate the valve 112 to regulate a minimum pressure, which may be application-specific, at the outlet of the valve 112 (and thus at the receiver 20). A receiver pressure sensor 112*p* measures the pressure at the outlet of the valve 112 and provides the pressure to the controller 112*c*.

The electronically controlled valve 112 can be operated to control the minimum receiver pressure in proportion to a signal from the intelligent valve controller 112*c*. The valve 112 can include an electronically positioned piston and the controller 112*c*. The pressure measurement from the receiver pressure sensor 112*p* can be used as an input (feedback) to the controller 112*c* to enable intelligent control of the outlet pressure of the receiver pressure regulating valve 112. The minimum receiver pressure needs to be maintained a pressure setting lower than that of the condenser pressure 102 to achieve refrigerant flow through the condenser 14. When the ambient conditions are such that valve 102 cannot sufficiently pressurize the receiver 20 to meet the minimum pressure differential requirements of the expansion devices, the receiver pressure regulating valve 112 outlet pressure (receiver pressure) will open and begin to bypass the condenser 14 to pressurize the receiver 20 to the valve controllers desired outlet pressure setpoint.

As stated above, the receiver pressure regulating valve 112 is responsible for maintaining a minimum receiver pressure to ensure appropriate inlet pressure to expansion valves 16*a*-16*n*. To prevent the reverse flow of high pressure refrigerant vapor into the condenser outlet, the electronic Receiver Pressure Regulating Valve 112 outlet pressure set point can be maintained below that of the electronic condenser pressure control valve 102, and thus the pressure at the receiver pressure regulating valve 112 will be less than the condenser outlet pressure This can be achieved by communicating the floating pressure set point from the electronic condenser pressure control valve controller 102*c* to the electronic receiver pressure regulating valve controller 112*c* via a data communication path, which may provide wired or wireless communication between the controllers 102*c* and 112*c*, and ensuring that a receiver pressure set point is less than the floating pressure set point for the condenser 14. Alternately, a single controller 114 may be in communication with electronic valves 102 and 112 to drive both electronic valves 102 and 112 and receive the required inputs for intelligent control.

The electronic receiver pressure regulating valve 112 may operate to maintain a differential pressure across the valve 112 and not an absolute outlet pressure. It is possible that an absolute outlet pressure, pressure differential or both may be employed as the controlled operational parameter. In one embodiment, the controllers 102*c* and 112*c* (or controller 114) are configured to maintain the condenser outlet pressure about 20 PSI higher than the receiver pressure.

Figure 7:
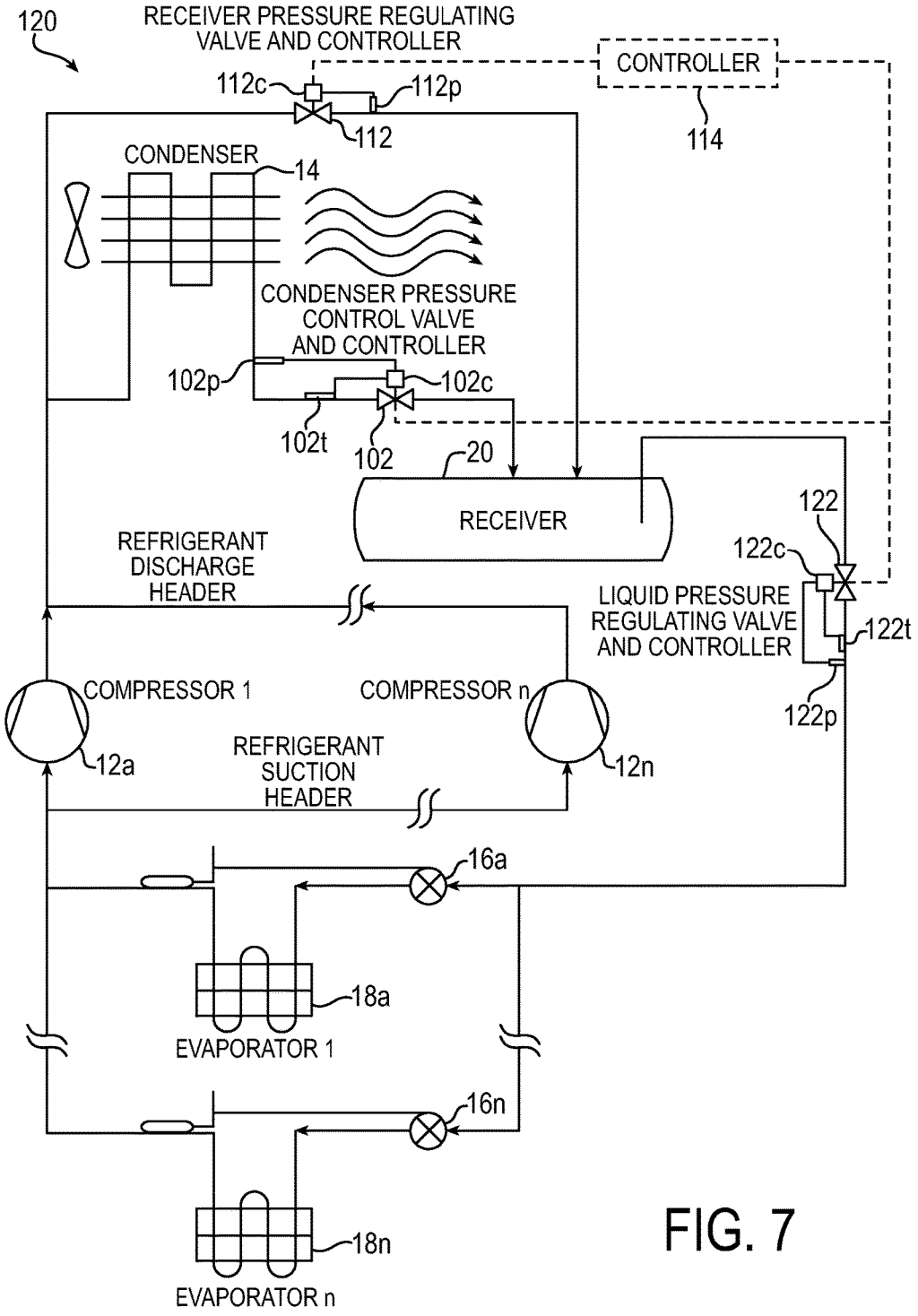
FIG. 7 is a schematic diagram of another exemplary vapor compression refrigeration system in accordance with aspects of the invention.

A further extension of the previous embodiment is depicted in FIG. 7. Instead of a mechanical liquid pressure regulating valve 26, the system 120 of FIG. 7 includes an electronic liquid pressure regulating valve 122 arranged between and in fluid communication with the receiver 20 and the expansion device(s) 16*a*-16*n*. The valve 122 can include an electronically positioned piston. The electronic valve 122 can be operated to control the liquid refrigerant pressure at the inlet of expansion valves 16*a*-16*n* in proportion to a signal from an intelligent valve controller 122*c*, which may be incorporated into the valve 122 or as a standalone controller 114. To maintain required subcooling of the refrigerant such that no vapor component reaches the expansion valves, the target pressure for the liquid refrigerant at the inlet of the expansion valves 16*a*-16*n* must be above the outlet pressure of the electronic condenser pressure control valve 102.

The controller 122*c* includes logic configured to operate the valve 122 based on the outlet pressure, outlet temperature or both of the refrigerants exiting the electronic Liquid Pressure Regulating Valve 122. Such pressure and temperature data can be provided to the controller 122*c*, for example, by a liquid pressure sensor 122*p* and a liquid temperature sensor 122*t*. The pressure and temperature of the refrigerant exiting the valve 122 directly affect the capacity of the expansion valves. The logic for operating the valve 122 can control these pressure and/or temperature values to provide maximum capacity with minimum mass flow and thus increased efficiency, thereby allowing use of smaller piping and valves which can lower installation costs.

As stated above, the valve 122 is responsible for maintaining a fixed inlet pressure to expansion valves 16*a*-16*n* or other desired refrigerant conditions. To enable the electronic Liquid Pressure Regulating Valve 122 to operate effectively, the Receiver Pressure Regulating valve outlet pressure (which is controlled by valve 112) must be greater than the pressure set point of the electronic liquid pressure regulating valve 122. This can be achieved by communicating the liquid pressure regulating valve 122 set point pressure to the receiver pressure regulating valve controller 112*c* via a data communications path, which may provide wired or wireless communication. Alternately, a single controller 114 may provide the output to drive the condenser pressure control valve 102, receiver pressure regulating valve 112 and the liquid pressure regulating valve 122 concurrently and receive the required inputs for intelligent control of each.

Figure 8:
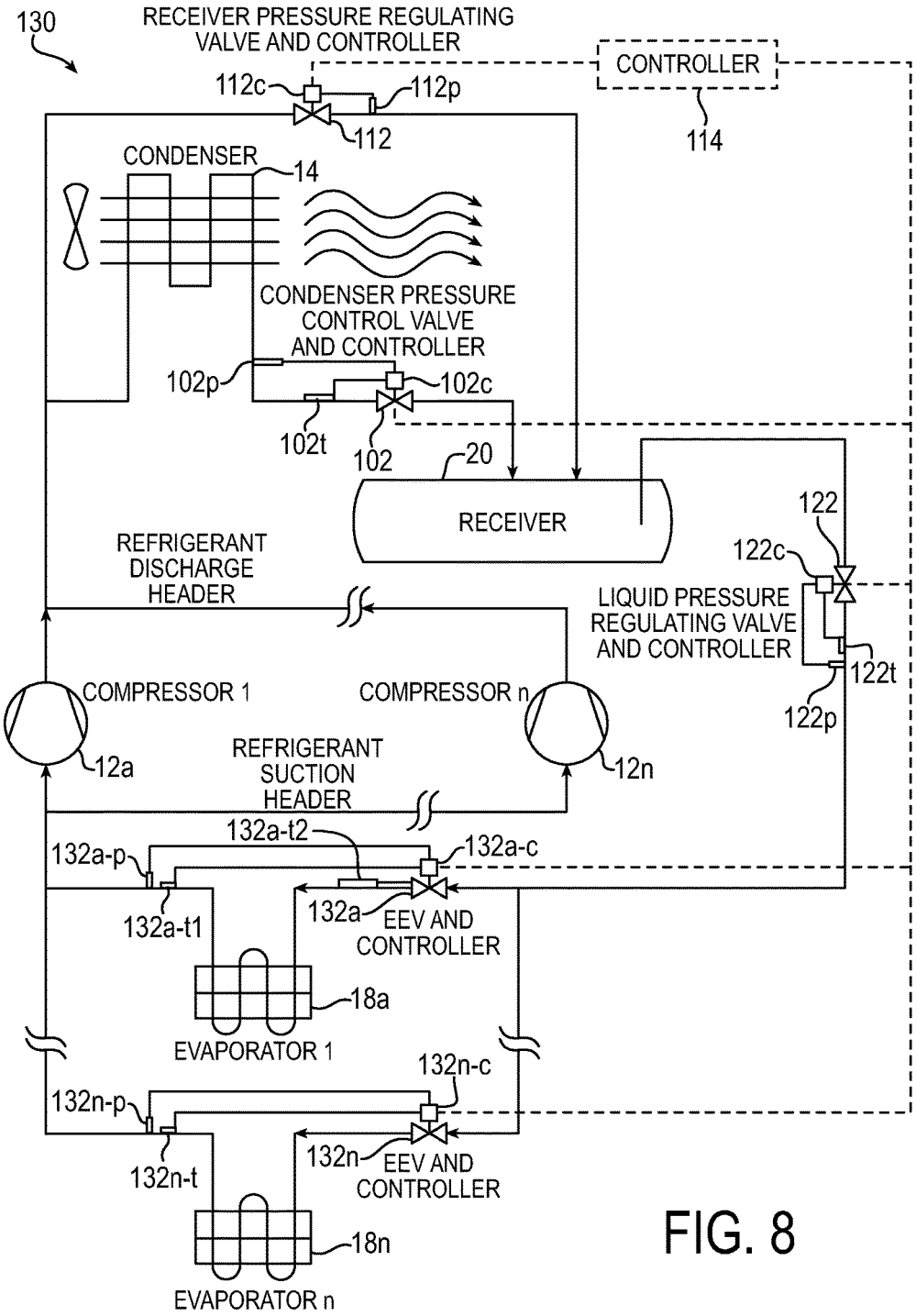
FIG. 8 is a schematic diagram of another exemplary vapor compression refrigeration system in accordance with aspects of the invention.

A further extension of the previous embodiment is depicted in FIG. 8. The system 130 of FIG. 8 includes one or more Electronic Expansion Valves (EEV) 132*a*-132*n* instead of mechanical Expansion Valves 16*a*-16*n*. The EEVs 132*a*-132*n* control flow through the evaporators 18*a*-18*n* in relation to load on the evaporators. In this regard, intelligent valve controller(s) 132*a-c* and 132*n-c* include logic configured to operate the EEVs 132*a*-132*n* to regulate refrigerant superheat as it exits the evaporator 18*a*-18*n* in proportion to a signal from the intelligent valve controller(s) 132*a-c* and 132*n-c*.

The EEVs 132*a*-132*n* can include electronically positioned piston and the controller 132*a-c* and 132*n-c*. The controller may be incorporated into the EEVs or may be a standalone controller 114. Evaporator pressure sensors 132*a-p* and 132*n-p* and evaporator temperature sensors 132*a-t*1 and 132*n-t*1 measure pressure and temperature at the outlet of evaporators 18*a*-18*n*, respectively, and provide the measurements to the controller, while temperature sensors 132*a-t*2-132*a-n*2 measure temperatures at the outlet of the EEV and provide them to the controller. The input to the controller 132*a-c* and 132*n-c* (or 114) to enable intelligent control of refrigerant superheat can include, but is not limited to, any combination of one or more variables: evaporator outlet pressure (from sensors 132*a-p* and 132*n-p*), evaporator outlet temperature (from sensors 132*a-t*1 and 132*n-t*1), expansion valve outlet temperature (from 132*a*-t2 and 132*n-t*2), expansion valve inlet temperature (from 122*t*), expansion valve inlet pressure (from 122*p*), valve flow profile and/or a calculated refrigerant superheat. The controllers 132*a-c* and 132*n-c* may establish a target superheat using an algorithm, and the above-referenced parameters can be used to position the valve to achieve and maintain that superheat value by controlling mass flow of refrigerant into the evaporator coil(s) 18*a*-18*n*. A flow curve can be used to linearize the equation for equating valve position to mass flow, and inlet refrigerant pressure and temperature can be used to determine valve capacity.

EEV pin or piston position can be communicated to the electronic condenser pressure control valve controller 102*c*, electronic receiver pressure regulating valve controller 112*c* and/or electronic liquid pressure regulating valve controller 122*c* via a data communication path to coordinate control such that a minimum condenser pressure set point may be calculated and controlled based in whole or in part by the requirements of the EEV 132*a*-132*n*. Additionally, evaporator superheat control as performed by the EEVs 132*a*-132*n* can be achieved utilizing an enhanced algorithm using refrigerant properties including but not limited to pressure, subcooling and temperature at the inlet to the EEV as communicated from the liquid pressure regulating valve controller 122*c*, condenser pressure control valve controller 102*c* and receiver pressure regulating valve controller 112*c* or any combination thereof. By monitoring superheat at the evaporators 18*a*-18*n*, the pressure set points for the electronic condenser pressure control valve 102, electronic receiver pressure regulating valve 112 and/or electronic liquid pressure regulating valve 122 can be set as low as desired while maintaining optimal system operation.

Figure 9:
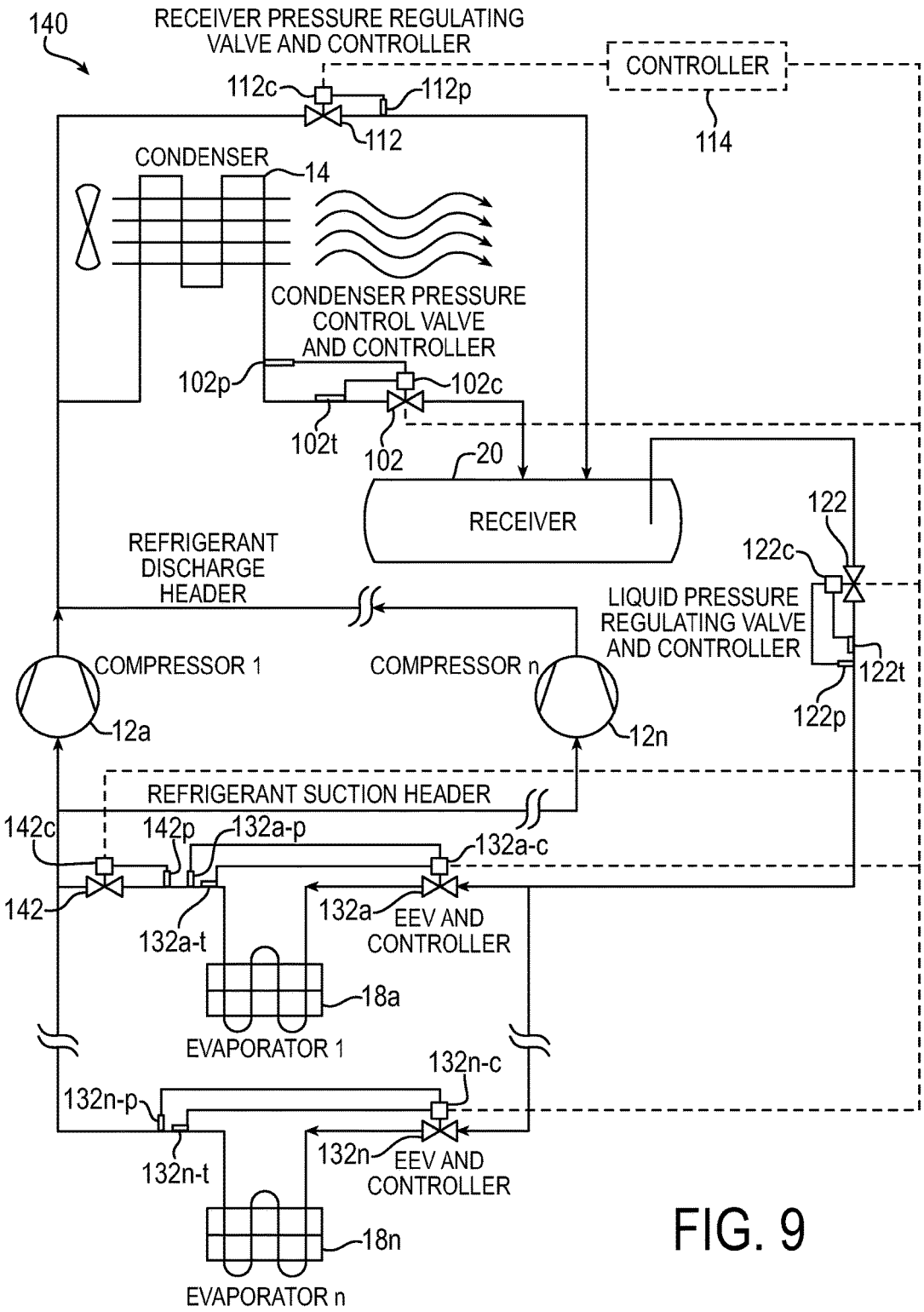
FIG. 9 is a schematic diagram of another exemplary vapor compression refrigeration system in accordance with aspects of the invention.

A further extension of the previous embodiment is depicted in FIG. 9. The system 140 of FIG. 9 includes an electronic evaporator pressure regulating valve (EEPR) 142 in fluid communication with an outlet of the evaporator 18*a*. The EEPR 142 can be operated to control refrigerant Saturated Suction Temperature (SST) in the evaporator(s) 18*a*-18*n* or measured medium temperature in proportion to a signal from an intelligent valve controller 142*c*. Pressure sensor 142*p* monitors the pressure at the outlet of the evaporator(s) and provides the data to the controller 142*c*. In controlling SST, the valve 142 can be configured to control evaporator pressure using the refrigerated space temperature or evaporator pressure as the control process variable. The valve 142 can be modulated to achieve and maintain either a temperature or pressure setpoint. There is a direct correlation between SST and Evaporator temperature. In some instances, it may be preferable to control based on refrigerated space temperature to compensate for refrigerated fixture design, product type and loading and other indoor ambient influences such as humidity, shopper traffic, etc. This can be applied to refrigerated mediums other than air such as a secondary fluid.

The valve 142 can include an electronically positioned piston and the controller 142*c*, which includes logic configured to operate the evaporator pressure regulating valve to control SST and/or a temperature of the refrigerated space based on evaporator outlet pressure. The controller 142*c* may be incorporated into the EEPR 142 or may be a standalone controller 114. The input to the controller to enable intelligent control of evaporator pressure can include evaporator outlet pressure. The improved quality of liquid refrigerant supplied to the EEV due to the coordinated control described in earlier embodiments can increase evaporator efficiency The EEPR 142 can be configured to close to counteract decreases in evaporator pressure or lowering of conditioned space temperature below a predetermined set point. EEPR valve piston position data can be supplied to the system controller 114 via a data communication path, which may provide wired or wireless communication. This data can be used by the system controller 114 to raise the system SST (compressor return gas pressure) set point resulting in further reduction of compressor $\Delta P$ and increased system EER.

According to another embodiment, the floating condenser pressure control can be coordinated with a condenser controller and/or a compressor controller. These controls may be separate, disposed within the same control device (e.g., controller 114) or components of a distributed control scheme (e.g., in one or more of the controllers 102*c*, 112*c*, 122*c* 132*a-c*, 142*c*). The condenser controller may include logic configured to control fixed speed or variable speed fans, Variable Frequency Drives controlling condenser fans, dampers to control air flow, valves to control fluid across the condenser and/or control valves that function to isolate one or more portions of the condenser. The compressor controller may be configured to monitor a control parameter such as Saturated Suction Temperature (SST) or Pressure (SSP) and determine individual compressor ON/OFF status or vary the capacity of one or more compressors via an attached variable speed drive apparatus to maintain a predetermined SST or SSP operating point. The coordination of controls can be achieved via data communication of control variables including but not limited to condenser pressure set point, SSP set point, SST set point, condenser outlet pressure, condensate temperature, refrigerant subcooling, refrigerant superheat, electronic receiver pressure regulating valve 112 position, electronic condenser pressure control valve 102 position, EEV 132*a*, 132*n* position and/or electronic evaporator pressure regulating valve 142 position. These system parameters and characteristics can be analyzed by the system controller to provide continuous optimization of system performance, failure mode mitigation and predictive failure analysis. For example, the controller can analyze the ability to raise system SST setpoint in reaction to EEPR valve positions in relation to refrigerated space temperatures. If temperatures are satisfied for a predetermined time and the valves are less than X % open (X % being application-specific), then the SST setpoint is raised to increase system EER. The EPRs would react by opening further to maintain the desired evaporator pressure.

Multiplexed commercial direct expansion refrigeration systems equipped with air cooled or evaporative cooler refrigerant condensers provide the condensing and subcooling mechanism to supply the system with liquid refrigerant. The condensing temperature and pressure are determined by the ambient conditions (temperature and humidity). The control mechanism for controlling condensing pressure can be ambient air movement across the condenser surface and/or controlling the usable condensing capacity by limiting the available condensing surface area either by removing some portion of the condensing surface from the system using valve and piping arrangements or by retaining liquid refrigerant in the condenser piping with a pressure controlled valve placed in the condenser outlet piping. During periods of low outdoor ambient temperatures the Saturated Condensing Temperature (SCT) and the corresponding Saturated Condensing Pressure (SCP) decrease. This provides an opportunity to lower the condensing pressure which is directly coupled to the vapor discharge outlet of the compressor 12. This lowers the pressure drop ($\Delta P$) across the compressor and reduces compressor energy usage and increases system capacity. This can provide a significant savings in the cost of operating the refrigeration system.

Figure 10:
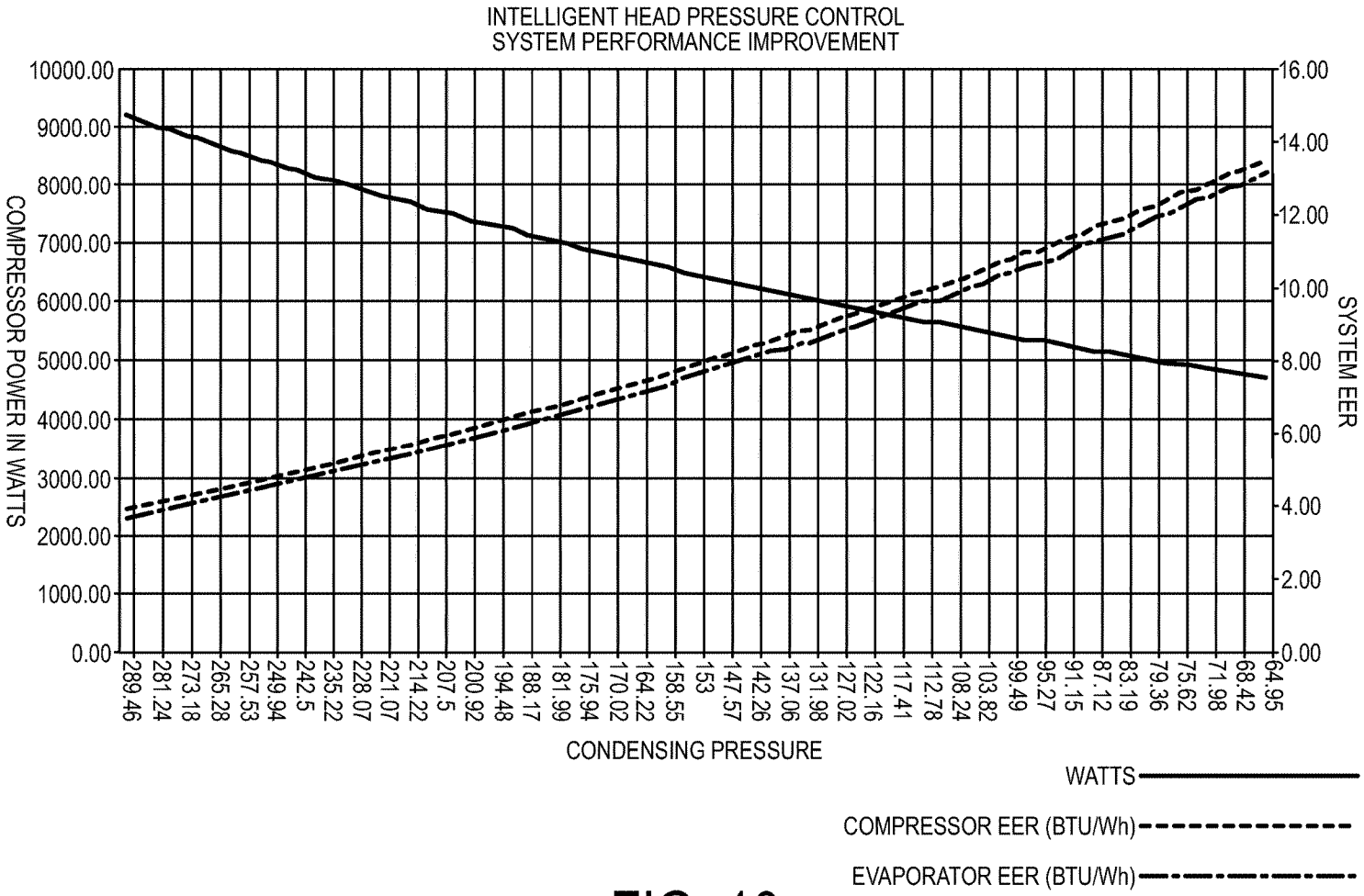
FIG. 10 is chart showing performance of a system in accordance with aspects of the system.

A difference between the system described herein and conventional floating discharge pressure strategies is that discharge pressure is controlled at the condenser outlet using the electronic condenser pressure control valve and controller. Current floating discharge pressure schemes are limited by the fixed setting of the mechanical condenser pressure control valve set point. The solution in accordance with the present disclosure overcomes this barrier and allows the discharge pressure and accordingly the compressor $\Delta P$ to float to the lowest level possible as determined by the outdoor ambient temperature, compressor operating envelope, minimum expansion valve inlet pressure and desired liquid refrigerant subcooling measured at the condenser outlet (condensate). Additionally, condenser refrigerant condensate subcooling can be controlled by varying the condensing pressure. Further, the system described herein can provide coordinated and enhanced control of the electronic receiver pressure regulating valve, electronic liquid pressure regulating valve, electronic expansion valves and electronic evaporator pressure regulating valves as described above. This system coordinated control results in further reduction in refrigeration system operating cost and improved performance, as can be seen in FIG. 10.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

The invention claimed is:

1. A refrigeration system, comprising:

a compressor, a condenser, a receiver, an electronic expansion valve, and an evaporator in fluid communication with one another;

an electronic condenser pressure control valve in fluid communication with an outlet of the condenser and operative to control a discharge pressure at the condenser outlet;

the electronic expansion valve in fluid communication with an inlet of the evaporator; and a controller operatively coupled to the electronic condenser pressure control valve and to the electronic expansion valve, the controller including first logic configured to operate the electronic condenser pressure control valve based on a compressor operating envelope, and use a position of the electronic expansion valve as communication data to control the operation of the electronic condenser pressure control valve through a data communication path.

2. The refrigeration system according to claim 1, wherein the first logic configured to operate the electronic condenser pressure control valve includes logic configured to operate the condenser pressure control valve based upon at least one of an outdoor ambient temperature, or minimum expansion valve inlet pressure and desired liquid refrigerant subcooling measured at the condenser outlet.

3. The refrigeration system according to claim 1, wherein the first logic that operates the electronic condenser pressure control valve includes logic that operates the electronic condenser pressure control valve to regulate a condenser outlet condition to a lowest desired level.

4. The refrigeration system according to claim 3, wherein the condenser outlet condition comprises a condensate pressure or a condensate temperature.

5. The refrigeration system according to claim 3, wherein the first logic configured to operate the electronic condenser pressure control valve to regulate the condenser outlet condition to a lowest desired level includes logic configured to regulate a refrigerant subcooling at the condenser outlet through control of Saturated Condensing Pressure (SCP).

6. The refrigeration system according to claim 3, wherein the first logic configured to operate the electronic condenser pressure control valve to regulate the condenser outlet condition to a lowest desired level includes logic configured to regulate the condenser outlet pressure to be greater than a pressure at the receiver.

7. The refrigeration system according to claim 1, further comprising at least one of a condenser pressure sensor operative to measure a pressure at the condenser outlet or a condenser temperature sensor operative to measure a temperature at the condenser outlet, the condenser pressure sensor or condenser temperature sensor communicatively coupled to the controller.

8. The refrigeration system according to claim 1, further comprising an electronic receiver pressure regulating valve in fluid communication with an outlet of the compressor and an inlet of the receiver and operative to control a pressure at the receiver, wherein the controller includes second logic configured to operate the electronic receiver pressure regulating valve to regulate a minimum pressure in the receiver.

9. The refrigeration system according to claim 8, wherein the second logic configured to operate the electronic receiver pressure regulating valve to regulate a minimum pressure in the receiver includes logic configured to control the receiver pressure regulating valve to regulate receiver pressure below condenser outlet pressure.

10. The refrigeration system according to claim 8, wherein the second logic configured to operate the electronic receiver pressure regulating valve to regulate a minimum pressure in the receiver includes logic configured to control the receiver pressure regulating valve to regulate a pressure differential across the receiver pressure regulating valve.

11. The refrigeration system according to claim 8, wherein the second logic configured to operate the electronic receiver pressure regulating valve to regulate a minimum pressure in the receiver includes logic configured to control the receiver pressure regulating valve to regulate an outlet pressure of the receiver pressure regulating valve.

12. The refrigeration system according to claim 8, further comprising a receiver pressure sensor communicatively coupled to the controller, the receiver pressure sensor operative to measure a pressure at an outlet of the electronic receiver pressure regulating valve.

13. The refrigeration system according to claim 1, further comprising an electronic liquid pressure regulating valve arranged between and in fluid communication with the receiver and the expansion device, the electronic liquid pressure regulating valve operative to control a pressure at an inlet of the expansion device.

14. The refrigeration system according to claim 13, wherein the controller includes third logic configured to operate the electronic liquid pressure regulating valve to regulate the pressure at the inlet of the expansion device based on at least one of a temperature or pressure of a refrigerant exiting the electronic liquid pressure regulating valve.

15. The refrigeration system according to claim 13, further comprising at least one of a liquid pressure sensor operative to measure a pressure at an outlet of the liquid pressure regulating valve or a liquid temperature sensor operative to measure a temperature at the liquid pressure regulating valve, the liquid pressure sensor or liquid temperature sensor communicatively coupled to the controller.

16. The refrigeration system according to claim 1, wherein the controller includes fourth logic configured to operate the electronic expansion valve to regulate refrigerant superheat based on at least one of evaporator outlet temperature, evaporator outlet pressure, expansion valve outlet temperature, expansion valve inlet temperature, expansion valve inlet pressure, expansion valve flow profile, expansion valve percentage open or calculated refrigerant superheat.

17. The refrigeration system according to claim 16, further comprising at least one of an evaporator pressure sensor operative to measure a pressure at an outlet of the evaporator or an evaporator temperature sensor operative to measure a temperature at the outlet of the evaporator, the evaporator pressure sensor or evaporator temperature sensor communicatively coupled to the controller.

18. The refrigeration system according to claim 1, further comprising an electronic evaporator pressure regulating valve in fluid communication with an outlet of the evaporator.

19. The refrigeration system according to claim 18, wherein the controller includes fifth logic configured to operate the electronic evaporator pressure regulating valve to regulate refrigerant saturated suction temperature (SST) in the evaporator or refrigerated space temperature based on evaporator outlet pressure or refrigerated medium temperature.

20. The refrigeration system according to claim 1, further comprising a second electronic expansion valve and a second evaporator in fluid communication with the compressor, the condenser, and the receiver, wherein the second electronic expansion valve and the second evaporator are in parallel with the electronic expansion valve and the evaporator.

21. The refrigeration system according to claim 1, further comprising at least one additional compressor in parallel with the compressor.

22. The refrigeration system according to claim 1, wherein the controller is a central controller operatively coupled to each of the valves.

23. The refrigeration system according to claim 1, wherein the controller comprises a plurality of controllers communicatively coupled to each other, each of the plurality of controllers operatively coupled to a respective one or more of the valves.

24. The refrigeration system according to claim 1, wherein the controller includes sixth logic configured to operate the electronic expansion valve to regulate refrigerant superheat based on at least one of expansion valve flow profile or expansion valve percentage open.

25. A method of controlling a refrigeration system that includes a compressor, a condenser, a receiver, an electronic condenser pressure control valve, an electronic expansion valve, and an evaporator in fluid communication with one another, the electronic condenser pressure control valve in fluid communication with an outlet of the condenser and operative to control a discharge pressure at the condenser outlet, and the electronic expansion valve in fluid communication with an inlet of the evaporator, the method comprising:

controlling the electronic condenser pressure control valve based on an operating envelope of the compressor, and using a position of the electronic expansion valve as communication data to control the operation of the electronic condenser pressure control valve through a data communication path.

* * * * *